US007341327B2

(12) United States Patent
Usuda

(10) Patent No.: US 7,341,327 B2
(45) Date of Patent: Mar. 11, 2008

(54) CAPPING UNIT AND CONTROL METHOD FOR SAME, LIQUID DROPLET EJECTION APPARATUS AND DEVICE MANUFACTURING METHOD

(75) Inventor: Hidenori Usuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 335 days.

(21) Appl. No.: 11/005,028

(22) Filed: Dec. 7, 2004

(65) Prior Publication Data

US 2005/0140718 A1 Jun. 30, 2005

(30) Foreign Application Priority Data

Dec. 25, 2003 (JP) ..... 2003-428492

(51) Int. Cl.
*B41J 2/165* (2006.01)

(52) U.S. Cl. ..... 347/23; 347/29; 347/30; 347/26

(58) Field of Classification Search ..... 347/14, 347/19, 22–35
See application file for complete search history.

(56) References Cited

U.S. PATENT DOCUMENTS

| | | | | |
|---|---|---|---|---|
| 5,493,319 | A * | 2/1996 | Hirabayashi et al. | 347/29 |
| 5,570,117 | A | 10/1996 | Karambelas et al. | |
| 6,000,778 | A * | 12/1999 | Koitabashi et al. | 347/23 |
| 6,652,056 | B2 * | 11/2003 | Shioya | 347/12 |

FOREIGN PATENT DOCUMENTS

| | | |
|---|---|---|
| JP | A 10-264402 | 10/1998 |
| JP | A 2000-127381 | 5/2000 |
| JP | A 2001-1555 | 1/2001 |

* cited by examiner

*Primary Examiner*—Shih-Wen Hsieh
(74) *Attorney, Agent, or Firm*—Oliff & Berridge, PLC

(57) ABSTRACT

A capping apparatus including: a sealing unit that seals at least nozzle apertures of a liquid droplet ejection head that ejects liquid droplets; a heating unit that heats at least a vicinity of the nozzle apertures; and a negative pressure supplying unit that supplies an interior of the sealing unit with negative pressure that causes liquid droplets to be ejected from the nozzle apertures.

14 Claims, 9 Drawing Sheets

CAPPING UNIT AND CONTROL METHOD FOR SAME, LIQUID DROPLET EJECTION APPARATUS AND DEVICE MANUFACTURING METHOD

BACKGROUND OF THE INVENTION

1. Field of the Invention

The present invention relates to a capping unit that seals (known as "capping") nozzle apertures in a liquid droplet ejection head and prevents drying of a liquid droplet solvent as well as clogging of the nozzle apertures, and to a method of controlling the capping unit, a liquid droplet ejection apparatus that includes the capping unit, and a device manufacturing method that uses the apparatus.

Priority is claimed on Japanese Patent Application No. 2003-428492, filed Dec. 25, 2003, the contents of which are incorporated herein by reference.

2. Description of Related Art

A liquid droplet ejection head is formed by a pressure generation chamber that houses a liquid droplet solvent, a piezoelectric element that pressurizes the pressure generation chamber, and nozzle apertures that are connected to the pressure generation chamber. As a result of the liquid droplet solvent in the pressure generation chamber being pressurized by the piezoelectric element, a minute quantity of liquid droplet solvent is ejected in the form of liquid droplets from nozzle apertures. In a liquid droplet ejection head having a structure such as this, if liquid droplet solvent evaporates in the vicinity of the nozzle apertures, or if an air bubble becomes blocked inside the liquid droplet ejection head, then a liquid droplet ejection malfunction occurs. Because of this, this type of liquid droplet ejection head requires a capping unit that seals the nozzle apertures so as to prevent drying of a liquid droplet solvent and also prevent blockages in the nozzle apertures.

Even if the nozzle apertures of a liquid droplet ejection head are sealed using a capping unit, if they are sealed for an extended period of time, then as a result of the moisture retaining properties of the liquid droplet solvent deteriorating due to evaporation of the liquid droplet solvent located on the flow path of the liquid droplet solvent and in the nozzle apertures or due to the liquid droplet solvent drying inside the capping unit, an increase in the viscosity of the liquid droplet solvent is generated and the nozzle apertures may become blocked. Because of this, the capping unit provided for the liquid droplet ejection head is one that expels liquid droplet solvent that has thickened in the vicinity of the nozzle apertures or ejects an air bubble that has become blocked in the pressure generation chamber by not only simply sealing the nozzle apertures of the liquid droplet ejection head, but by forcibly causing liquid droplet solvent to be expelled from the nozzle apertures by causing negative pressure to act on the nozzle apertures using a suction pump.

Note that, in addition to methods that use a capping unit, methods of clearing blockages in nozzle apertures include a method that uses a cleaning device that wipes a surface in which the nozzle apertures of the liquid droplet ejection head are formed using a wiper, and a flushing method that forcibly ejects a larger number of liquid droplets than a normal liquid droplet ejection quantity by increasing the pressure that is applied to the pressure generation chamber by the piezoelectric element. A conventional capping unit is described in detail, for example, in Japanese Unexamined Patent Application, First Publication No. H10-264402.

When a blockage forms in a liquid droplet ejection head, the aforementioned suctioning by a capping unit, cleaning by a cleaning device, or flushing is performed. However, if the blockage is not cleared, the suctioning, cleaning or flushing are performed a large number of times. Therefore, the problem has arisen that the ejection quantity of liquid droplet solvent from nozzle apertures where a blockage has not formed increases so that liquid droplet solvent is consumed needlessly.

Moreover, if the suctioning or the like is performed on a plurality of occasions, the problem arises that it takes time for a normal state (i.e., a state in which liquid droplets can be ejected from all the nozzle apertures) to be restored. In recent years, liquid droplet ejection heads have been used for the manufacture of filters used in liquid crystal display apparatuses, micro displays, as well as a variety of devices that have micro patterns. If it takes time until a normal state is restored, then a problem may arise in that throughput (i.e., the number of devices that can be manufactured in a unit time) is reduced by a corresponding amount.

The present invention was conceived in view of the above described circumstances, and it is an object thereof to provide a capping unit that enables blockages and the like in nozzle apertures of a liquid droplet ejection head to be cleared in a short time while restraining the needless consumption of liquid droplet solvent, as well as to a control method for the capping unit, a liquid droplet ejection apparatus that includes the capping unit, and a device manufacturing method that manufactures a device using the liquid droplet ejection apparatus.

SUMMARY OF THE INVENTION

In order to solve the above described problems, the capping apparatus of the present invention includes a sealing unit that seals at least the nozzle apertures of a liquid droplet ejection head that includes the nozzle apertures that eject liquid droplets, and includes: a heating unit that heats at least the vicinity of the nozzle apertures of the liquid droplet ejection head; and a negative pressure supplying unit that supplies an interior of the sealing unit that seals the nozzle apertures with negative pressure that causes liquid droplets to be ejected from the nozzle apertures.

According to this invention, by supplying the interior of the sealing unit that seals the nozzle apertures with negative pressure after heating the vicinity of the nozzle apertures of the liquid droplet ejection head, it is possible to lower the viscosity of thickened liquid droplet solvent or to melt solidified liquid droplet solvent and forcibly eject it from the nozzle apertures. As a result, it is possible to clear blockages in the nozzle apertures in a short time while restraining needless consumption of liquid droplet solvent.

The capping apparatus of the present invention may further include a control unit that controls a heating time of the vicinity of the nozzle apertures by the heating unit, and that controls a negative pressure supply time by the negative pressure supplying unit.

According to this invention, because the heating time of the vicinity of the nozzle apertures and the negative pressure supply time are controlled by the control unit, it is possible to secure a sufficient heating time that is required in order to lower the viscosity of thickened liquid droplet solvent or melt solidified liquid droplet solvent. In addition, because it is possible to secure just the sufficient expulsion time that is required to only eject the liquid droplet solvent whose viscosity has been lowered or the melted liquid droplet solvent, it is possible not only to keep the needless consumption of liquid droplet solvent to a minimum, but also to reliably clear blockages in the nozzle apertures in a short time.

Moreover, in the capping apparatus of the present invention, the control unit may include a time measuring unit that measures a length of time during which the nozzle apertures have been sealed by the sealing unit, and the control unit performs control to change the heating time and the negative pressure supply time in accordance with the length of time measured by the time measuring unit.

According to this invention, because the length of time that the nozzle apertures are sealed by the liquid droplet ejection head is measured, and the heating time and negative pressure supply time are changed in accordance with this measurement result, it is possible to set the heating time and negative pressure supply time in accordance with the extent of the increase in viscosity of the liquid droplet solvent or with the extent of the solidification of liquid droplet solvent, so that it is possible not only to keep the needless consumption of liquid droplet solvent to a minimum, but also to reliably clear blockages in the nozzle apertures in a short time.

Furthermore, in the capping apparatus of the present invention, there may be further provided a temperature measuring unit that measures a temperature in the vicinity of the nozzle apertures, and the heating unit adjusts the heating temperature of the vicinity of the nozzle apertures based on the temperature measured by the temperature measuring unit.

According to this invention, because the heating temperature of the vicinity of the nozzle apertures is adjusted based on a result of a measurement of the temperature in the vicinity of the nozzle apertures, it is possible to maintain a constant heating temperature irrespective of the surrounding temperature. The result of this is that it is possible to effectively lower the viscosity of thickened liquid droplet solvent or melt solidified liquid droplet solvent, resulting in it being possible to reliably clear blockages in the nozzle apertures in a short time.

In order to solve the above described problems, the present invention is directed to a method for controlling a capping apparatus including a sealing unit that seals at least the nozzle apertures of a liquid droplet ejection head that eject liquid droplets, including the steps of: heating a vicinity of the nozzle apertures of the liquid droplet ejection head; and supplying an interior of the sealing unit with negative pressure so that liquid droplets are ejected from the nozzle apertures.

According to this invention, by supplying the interior of the sealing unit that seals the nozzle apertures with negative pressure after heating the vicinity of the nozzle apertures of the liquid droplet ejection head, it is possible to lower the viscosity of thickened liquid droplet solvent or to melt solidified liquid droplet solvent and forcibly eject it from the nozzle apertures. As a result, it is possible to clear blockages in the nozzle apertures in a short time while restraining unnecessary consumption of the liquid droplet solvent.

The method for controlling a capping apparatus of the present invention may further include the steps of making a determination as to whether or not an ejection of the liquid droplets has been made from each of the nozzle apertures, and heating the vicinity of the nozzle apertures and supplying negative pressure to the interior of the sealing unit in accordance with the determination.

According to this invention, because a determination is made in advance as to whether or not an ejection of the liquid droplets has been made from each of the nozzle apertures, and heating of the vicinity of the nozzle apertures and supplying of negative pressure to the interior of the sealing unit that seals the nozzle apertures are performed in accordance with the determination, only when a malfunction occurs in which liquid droplets are not ejected, such as a blockage of the nozzle apertures, is an ejection of liquid droplets made in order to clear the malfunction. By performing this control, compared, for example, with when heating and supplying of negative pressure are performed regularly, there is no unnecessary ejection of liquid droplet solvent. As a result, it is possible to restrain the consumption of liquid droplet solvent and to eliminate the time required by liquid droplet ejections performed for heating or supplying negative pressure.

In the method for controlling a capping apparatus of the present invention, the step of heating a vicinity of the nozzle apertures of the liquid droplet ejection head and the step of supplying an interior of the sealing unit with negative pressure so that liquid droplets are ejected from the nozzle apertures may be performed at the same time.

According to this invention, because the heating of the vicinity of the nozzle apertures is performed at the same time as negative pressure is supplied to the interior of the sealing unit that seals the nozzle apertures, it is possible to shorten the time required for liquid droplet ejection.

Alternatively, in the method for controlling a capping apparatus of the present invention, the step of heating the vicinity of the nozzle apertures and the step of supplying an interior of the sealing unit with negative pressure may be performed at the same time after the vicinity of the nozzle apertures has undergone preliminary heating.

According to this invention, because the heating of the vicinity of the nozzle apertures and the supplying of the negative pressure to the interior of the sealing unit that seals the nozzle apertures are performed at the same time as each other and after the preliminary heating of the vicinity of the nozzle apertures, it is possible to set a longer heating time, resulting it in it being possible to effectively lower the viscosity of thickened liquid droplet solvent or to effectively melt solidified liquid droplet solvent.

In the method for controlling a capping apparatus of the present invention, the method may further include the steps of measuring a length of time during which the nozzle apertures have been sealed by the sealing unit, and changing a length of time during which the vicinity of the nozzle apertures is heated and a length of time during which the interior of the sealing unit is supplied with negative pressure accordance with the length of time that the nozzle apertures have been sealed measured by the sealing unit.

According to this invention, because the supply of negative pressure to the interior of the sealing unit that seals the nozzle apertures is performed after the preliminary heating of the nozzle apertures, it is possible to perform an ejection after sufficiently lowering the viscosity of thickened liquid droplet solvent or after sufficiently melting solidified liquid droplet solvent.

Moreover, the method for controlling a capping apparatus of the present invention may further include the steps of measuring a length of time during which the nozzle apertures have been sealed by the sealing unit, and changing a length of time during which the vicinity of the nozzle apertures is heated and a length of time during which the interior of the sealing unit is supplied with negative pressure accordance with the length of time that the nozzle apertures have been sealed measured by the sealing unit.

According to this invention, because the length of time that the nozzle apertures of the liquid droplet ejection head have been sealed is measured and the heating time and negative pressure supply time are changed in accordance with the result of this measurement, it is possible to set the heating time and negative pressure supply time in accordance with the extent of the increase in viscosity of the liquid droplet solvent or with the extent of the solidification of liquid droplet solvent, so that it is possible not only to keep the needless consumption of liquid droplet solvent to a minimum, but also to reliably clear blockages in the nozzle apertures in a short time.

The method for controlling a capping apparatus of the present invention may further include the step of changing a magnitude of the negative pressure that is supplied to the interior of the sealing unit.

According to this invention, because the size of the negative pressure that is supplied to the interior of the sealing unit that seals the nozzle apertures is changed, it is possible to control the amount of liquid droplets that are ejected per unit time, and it is possible to shorten the time in which liquid droplets are ejected.

In order to solve the above described problems, the liquid droplet ejection apparatus of the present invention includes: a liquid droplet ejection head including pressure generating elements that generate pressure in response to a supplied drive signal, and nozzle apertures from which are ejected liquid droplets that are pressurized by pressure generated by the pressure generating elements; a drive signal generating unit that supplies the pressure generating elements with a heating drive signal that heats a vicinity of the nozzle apertures without causing liquid droplets to be ejected from the nozzle apertures; and a capping apparatus including a sealing unit that seals the nozzle apertures and a negative pressure supplying unit that supplies an interior of the sealing unit with negative pressure that causes liquid droplets to be ejected from the nozzle apertures.

According to this invention, by supplying negative pressure to the interior of the sealing unit that seals the nozzle apertures after the vicinity of the nozzle apertures of the liquid droplet ejection head is heated using the pressure generating elements provided in the liquid droplet ejection head, it is possible to lower the viscosity of thickened liquid droplet solvent or melt solidified liquid droplet solvent and forcibly eject it from the nozzle apertures. As a result, it is possible to clear blockages in the nozzle apertures in a short time while restraining unnecessary consumption of liquid droplet solvent. Moreover, because the vicinity of the nozzle apertures of the liquid droplet ejection head is heated using the pressure generating elements provided in the liquid droplet ejection head, it is possible to achieve a reduction in size and a reduction in the cost of the liquid droplet ejection head compared with when a heating unit is provided separately from the pressure generating elements.

The liquid droplet ejection apparatus of the present invention may further include a determining unit that makes a determination as to whether or not an ejection of the liquid droplets has been made from each of the nozzle apertures; and a control unit that controls at least one of the drive signal generating unit and the negative pressure supplying unit provided in the capping apparatus in accordance with detection results of the detection unit.

According to this invention, because a determination is made in advance as to whether or not an ejection of the liquid droplets has been made from each of the nozzle aperture and heating of the vicinity of the nozzle apertures and supplying of negative pressure to the interior of the sealing unit that seals the nozzle apertures are performed in accordance with the determination, only when a malfunction occurs in which liquid droplets are not ejected, such as a blockage of the nozzle apertures, is an ejection of liquid droplets made in order to clear the malfunction. By performing this control, compared, for example, with when heating and supplying of negative pressure are performed regularly, there is no unnecessary ejection of liquid droplet solvent. As a result, it is possible to restrain the consumption of liquid droplet solvent and to eliminate the time required by liquid droplet ejections performed for heating or supplying negative pressure.

In the liquid droplet ejection apparatus of the present invention, the control unit may include a time measuring unit that measures a length of time during which the nozzle apertures of the liquid droplet ejection head have been sealed by the sealing unit, and the control unit controls a length of time during which the drive signal generating unit supplies the pressure generating elements with the heating drive signals and the length of time that the interior of the sealing unit is supplied with negative pressure in accordance with the length of time measured by the time measuring unit.

According to this invention, because the length of time that the nozzle apertures of the liquid droplet ejection head have been capped is measured, and the length of time of the heating by the pressure generating elements and a length of negative pressure supply time by the negative pressure supply device are changed in accordance with the results of this measurement, it is possible to set the heating time and negative pressure supply time in accordance with the extent of the increase in viscosity of the liquid droplet solvent or with the extent of the solidification of liquid droplet solvent, so that it is possible not only to keep the needless consumption of liquid droplet solvent to a minimum, but also to reliably clear blockages in the nozzle apertures in a short time.

In the liquid droplet ejection apparatus of the present invention, the heating drive signal may have a repetition frequency in an ultrasonic frequency band.

Moreover, in the liquid droplet ejection apparatus of the present invention, the repetition frequency may be 40 kHz or more.

Furthermore, in the liquid droplet ejection apparatus of the present invention, the amplitude of the heating drive signals may be half or less the amplitude of a drive signal that is applied to the pressure generating element when the liquid droplets are ejected from the nozzle apertures.

The method of manufacturing a device of the present invention is a method of manufacturing a device that includes a work piece on which is formed a pattern having functionality in a predetermined location, including the steps of: ejecting liquid droplets from the nozzle apertures that are provided in the liquid droplet ejection head using a capping apparatus described above, or using a method for controlling a capping apparatus described above, or using a liquid droplet ejection apparatus described above all; and forming the pattern by ejecting liquid droplets onto the work piece using a liquid droplet ejection head after the step of ejecting liquid droplets from the nozzle apertures has been completed.

According to this invention, the viscosity of thickened liquid droplet solvent is lowered or solidified liquid droplet solvent is melted and this liquid droplet solvent is then ejected using the above described capping apparatus, the method for controlling a capping apparatus, or liquid droplet ejection apparatus. Using a liquid droplet ejection head that has undergone this processing, a pattern is then formed on the work piece by ejecting liquid droplets thereon. As a result, it is possible not only to restraining unnecessary consumption of liquid droplet solvent, but also to extend the liquid droplet ejection time for forming the pattern. The result of this is that it is possible to reduce device manufacturing costs, and improve throughput.

DETAILED DESCRIPTION OF THE INVENTION

The capping unit as well as the control method for the capping unit, the liquid droplet ejection apparatus, and the device manufacturing method according to an embodiment of the present invention will now be described in detail with reference made to the drawings.

Liquid Droplet Ejection Apparatus

Figure 1:
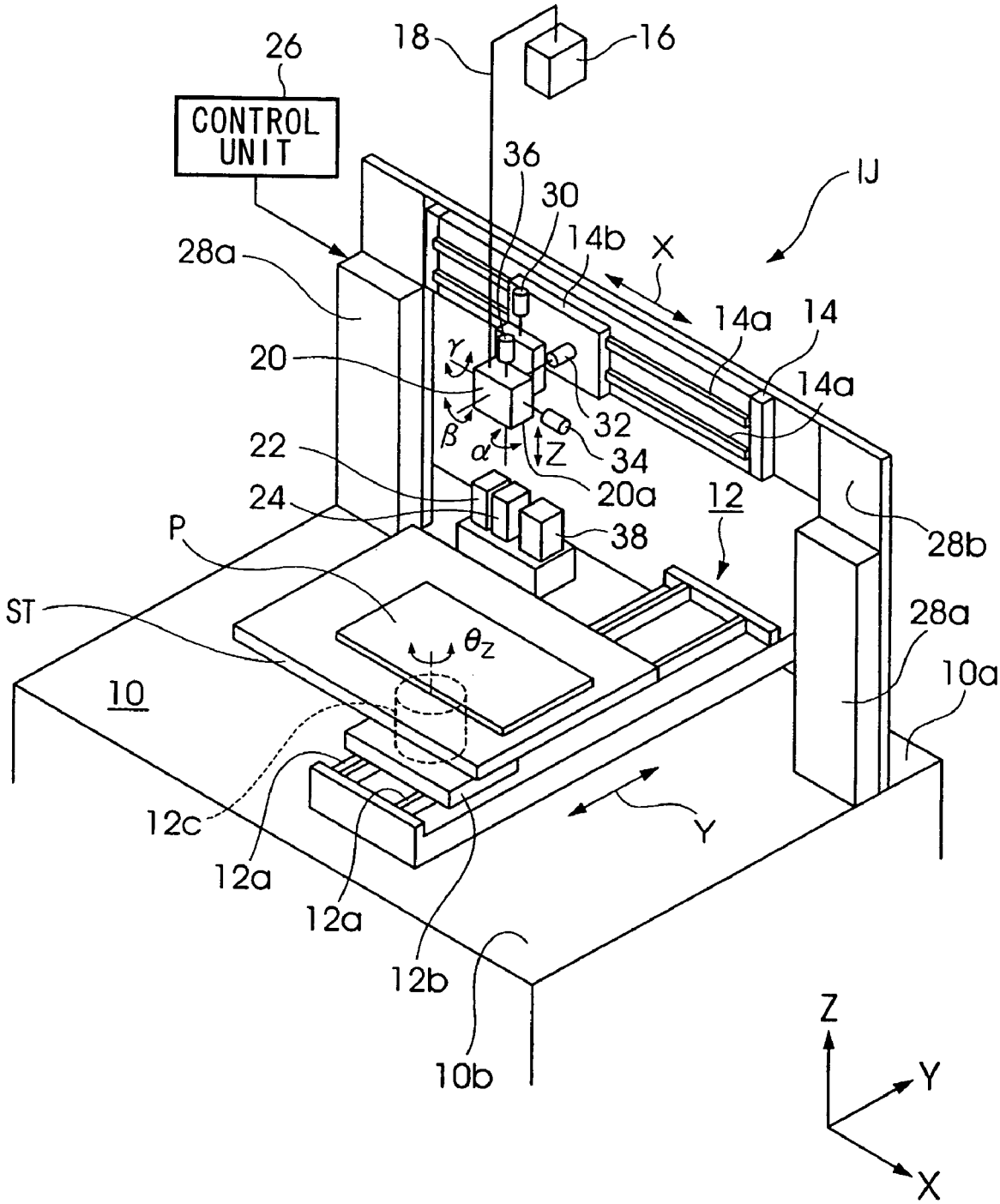
FIG. 1 is a perspective view showing the schematic structure of a liquid droplet ejection apparatus according to an embodiment of the present invention.

FIG. 1 is a perspective view showing the schematic structure of a liquid droplet ejection apparatus according to an embodiment of the present invention. Note that, in the description given below, where necessary an XYZ rectangular coordinate system is set in the drawings, and the positional relationship between each member is described with reference made to this XYZ rectangular coordinate system. In the XYZ rectangular coordinate system, the XY plane is set to a plane that is parallel with a horizontal plane, while the Z axis is set to a vertically upright direction. In addition, the direction of movement of the ejection head (i.e., the liquid droplet ejection head) 20 in the present embodiment is set to the X direction, and the direction of movement of a stage ST is set to the Y direction.

As shown in FIG. 1, a liquid droplet ejection apparatus IJ of the present embodiment is configured so as to include a base 10, a stage ST that supports a substrate P such as a glass substrate on the base 10, and an ejection head 20 that is supported above the stage ST (i.e., in a +Z direction), and that is able to eject predetermined liquid droplets onto the substrate P. Between the base 10 and the stage ST is provided a first moving member 12 that supports the stage ST such that it is able to move in the Y direction. A second moving member 14 that supports the ejection head 20 such that it is able to move in the X direction is provided above the stage ST.

A tank 16 that stores solvent of liquid droplets (i.e., liquid droplet solvent) that is ejected from the ejection head 20 via a flow path 18 is connected to the ejection head 20. A capping unit (i.e., a capping unit) 22 and a cleaning unit 24 are also provided above the base 10.

A control unit 26 controls each section of the liquid droplet ejection apparatus IJ (for example, the first moving member 12 and the second moving member 14 and the like), and controls the overall operation of the liquid droplet ejection apparatus IJ.

The first moving member 12 is provided on the base 10, and is positioned in the Y axial direction. This first moving member 12 may be formed, for example, by a linear monitor, and is provided with guide rails 12*a* and with a slider 12*b* that is provided so as to be able to move along the guide rails 12*a*. The slider 12*b* of this linear motor type of first moving member 12 is able to be positioned by moving in the Y axial direction along the guide rails 12*a*.

The slider 12*b* is provided with a motor 12*c* for rotating around the Z axis ($\theta_Z$). This motor 12*c* may, for example, be a direct drive motor, and a rotor of the motor 12*c* is fixed to the stage ST. As a result, by energizing the motor 12*c*, the rotor and the stage ST rotate in the $\theta_Z$ direction, enabling the stage ST to be indexed (i.e., rotation indexed). Namely, the first moving member 12 is able to move stage ST in the Y axial direction and the $\theta_Z$ direction. The stage ST holds the substrate P, and positions it at a predetermined position.

The stage ST has a suction holding device (not shown), and when this suction holding device is operated, the substrate P is suctioned onto the stage ST via suction holes (not shown) that are provided in the stage ST and is held there.

The second moving member 14 is mounted standing upright relative to the base 10 using supporting columns 28*a*, and is mounted on a rear portion 10*a* of the base 10. The second moving member 14 is formed by a linear motor, and is supported on a column 28*b* that is fixed to the supporting columns 28*a*. The second moving member 14 is provided with guide rails 14*a* that are supported on the column 28*b*, and with a slider 14*b* that is supported so as to be able to move in the X axial direction along the guide rails 14*a*. The slider 14*b* can be positioned by moving in the X axial direction along the guide rails 14*a*. The aforementioned ejection head 20 is mounted on the slider 14*b*.

The ejection head 20 has swinging positioning apparatuses in the form of motors 30, 32, 34, and 36. When the motor 30 is driven, the ejection head 20 can be moved up or down in the Z direction, enabling the ejection head 20 to be positioned at a desired position in the Z direction. When the motor 32 is driven, the ejection head 20 can be swung in the β direction around the Y axis, enabling the angle of the ejection head 20 to be adjusted. When the motor 34 is driven, the ejection head 20 can be swung in the γ direction around the X axis, enabling the angle of the ejection head 20 to be adjusted. When the motor 36 is driven, the ejection head 20 can be swung in the α direction around the Z axis, enabling the angle of the ejection head 20 to be adjusted.

In this manner, the ejection head 20 shown in FIG. 1 is supported on the slider 14*b* so as to be able to move rectilinearly in the Z direction, and so as to be able to swing in the α direction, β direction, and γ direction, enabling the angle thereof to be adjusted. The position and attitude of the ejection head 20 are precisely controlled by a control unit 26 such that the position or attitude of a liquid droplet ejection surface 20*a* relative to the substrate P on the stage ST side is a predetermined position or a predetermined attitude. A plurality of nozzle apertures that eject liquid droplets are provided in the liquid droplet ejection surface 20*a* of the ejection head 20.

As the liquid droplets that are ejected from the aforementioned ejection head 20, it is possible to employ liquid droplets that contain a variety of materials such as ink containing a coloring agent, a dispersion solution containing a material such as fine metal particles, solutions containing a hole injection material such as PEDOT:PSS or organic electroluminescent (EL) material such as a light emitting material, a high viscosity functional liquid such as a liquid crystal material, a functional liquid containing material for a micro lens, and biological polymer solutions containing protein or nucleic acid or the like.

Figure 2:
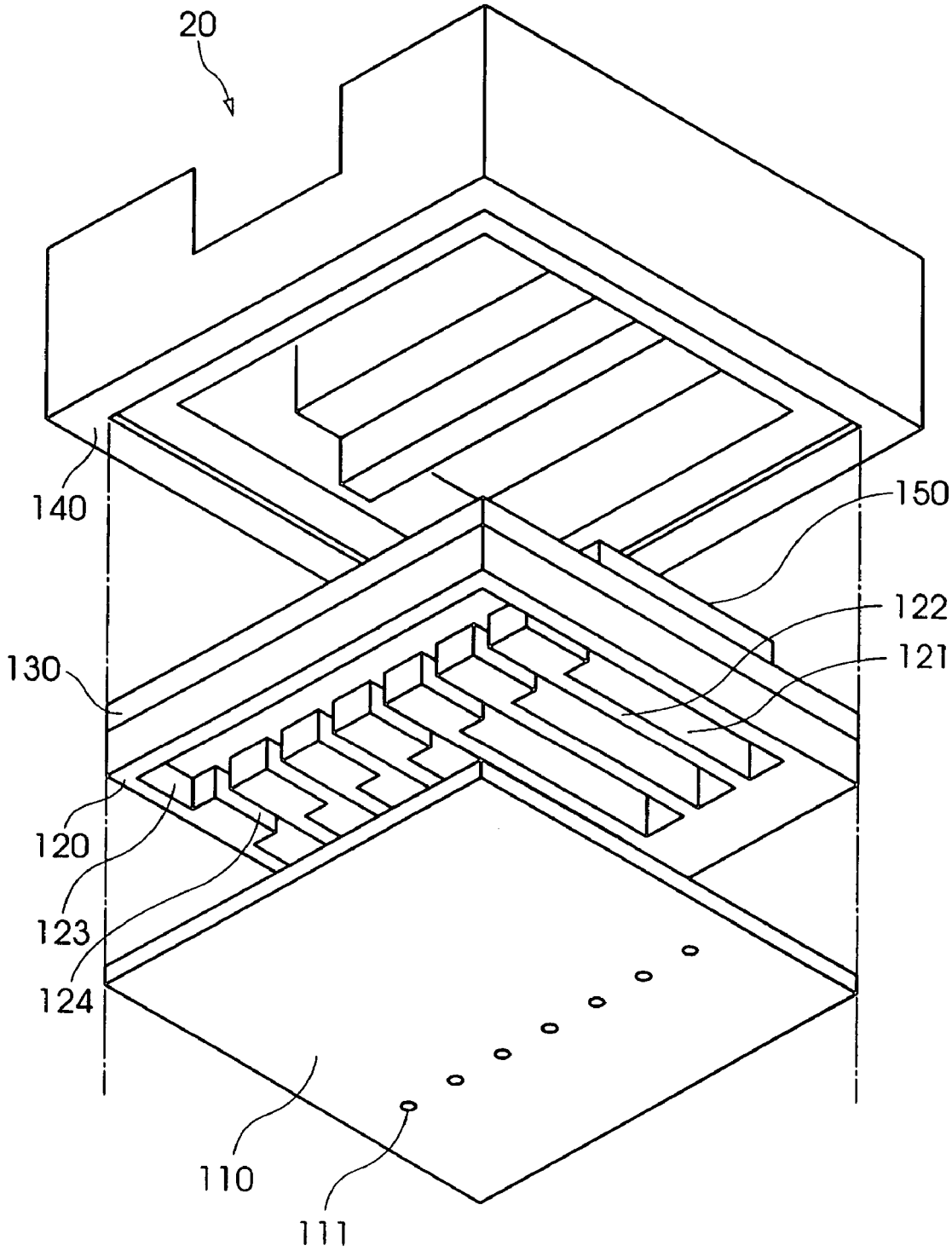
FIG. 2 is an exploded perspective view of an ejection head 20.
Figure 3:
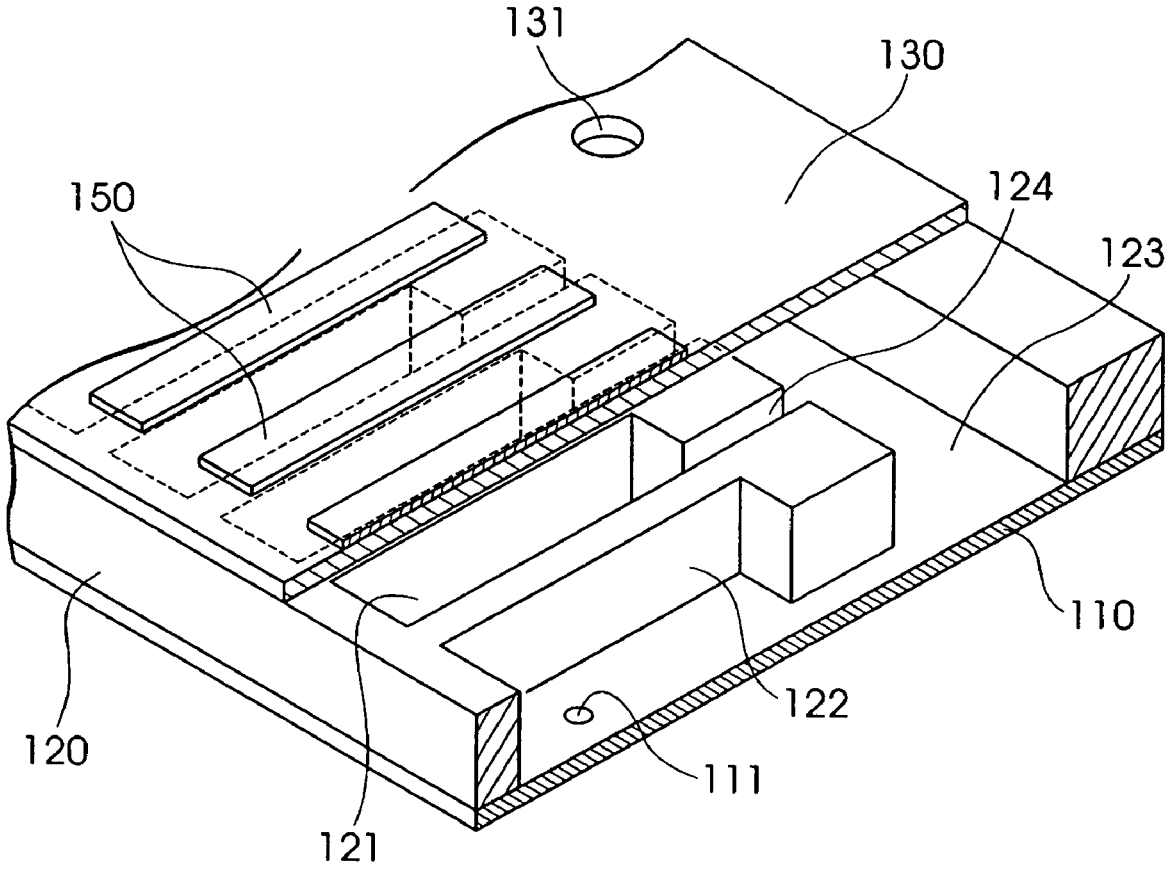
FIG. 3 is a perspective view showing a portion of the principal portions of the ejection head 20.

Here, the structure of the ejection head 20 will be described. FIG. 2 is an exploded perspective view of the ejection head 20. FIG. 3 is a perspective view showing a portion of principal portions of the ejection head 20. The ejection head 20 shown in FIG. 2 is formed to include a nozzle plate 110, a pressure chamber substrate 120, a diaphragm 130, and a housing 140. As shown in FIG. 2, the pressure chamber substrate 120 is provided with a cavity 121, a sidewall 122, a reservoir 123, and a supply port 124. The cavity 121 is a pressure chamber and is formed by etching a substrate made of silicon or the like. The sidewall 122 is formed so as to divide the cavity 121, and the reservoir 123 is formed as a common flow path that is able to supply liquid droplet solvent when each cavity 121 is being filled with the liquid droplet solvent. The supply port 124 is formed to allow liquid droplet solvent to be introduced into each cavity 121.

As shown in FIG. 3, the diaphragm 130 is formed so as to be able to be adhered to one surface of the pressure chamber substrate 120. A piezoelectric element 150, which is a component of the aforementioned piezoelectric device, is provided in the diaphragm 130. The piezoelectric element 150 is a ferroelectric crystal having a perovskite structure, and is formed in a predetermined configuration on the diaphragm 130. The piezoelectric element 150 is configured so as to be able to generate a change in volume in response to a drive signal supplied from the control unit 26. The nozzle plate 110 is adhered to the pressure chamber substrate 120 such that the nozzle apertures 111 thereof are placed at positions that correspond to each of the plurality of cavities (i.e., pressure chambers) 121 that are provided in the pressure chamber substrate 120. The pressure chamber substrate 120 to which the nozzle plate 110 has been adhered is further embedded in the housing 140, as shown in FIG. 2, so as to form the liquid droplet ejection head 20.

In order to eject liquid droplets from the ejection head 20, firstly, the control unit 26 supplies a drive signal for ejecting liquid droplets to the ejection head 20. Liquid droplet solvent has been supplied to the cavities 121 of the ejection head 20, and when a drive signal is supplied to the ejection head 20, the piezoelectric elements 150 provided in the ejection head 20 generate a change in volume in response to that drive signal. This change in volume deforms the diaphragm 130, and causes the volume of the cavity 121 to change. As a result, liquid droplets are ejected from the nozzle aperture 111 of that cavity 121. The liquid droplets that had been decreased by the ejection are then refilled from the tank to the cavity 121 from which the liquid droplets were ejected.

By applying drive voltages in which the drive voltage and waveform (i.e., the maximum voltage and the frequency) that are applied when ejecting liquid droplets are different, the piezoelectric elements 150 that are provided in the ejection head 20 are able to heat the liquid droplet solvent inside the cavities 121 without ejecting any liquid droplets from the nozzle apertures 111. Namely, the piezoelectric elements 150 can be used as a heating unit to heat the vicinity of the nozzle apertures 111. Note that the ejection head described with reference to FIG. 2 and FIG. 3 is structured so as to eject liquid droplets by generating a volume change in a piezoelectric element, however, it may also have a head structure that ejects liquid droplets by using a heating element to apply heat to the liquid droplet solvent so that the liquid droplet solvent expands. It may also be an ejection head that ejects liquid droplets by generating a volume change by deforming the diaphragm using static electricity.

Returning to FIG. 1, as a result of the second moving member 14 moving the ejection head 20 in the X axial direction, the ejection head 20 can be selectively positioned above the cleaning unit 24 or the capping unit 22. Namely, if, for example, the ejection head 20 is moved above the cleaning unit 24 during a device manufacturing process, the ejection head 20 can be cleaned. Moreover, if the ejection head 20 is moved above the capping unit 22, then it is possible to perform capping on the liquid droplet ejection surface 20*a* of the ejection head 20, or to fill the cavities 121 with liquid droplets, or to repair ejection malfunctions caused by blockages in the nozzle apertures 111.

Namely, the cleaning unit 24 and the capping unit 22 are placed apart from the stage ST directly below the movement path of the ejection head 20 on the rear portion 10*a* side on top of the base 10. Because the tasks of transporting the substrate P onto the stage ST and removing the substrate P from the stage ST are carried out on the front portion 10*b* side of the base 10, these tasks are not obstructed by the cleaning unit 24 or the capping unit 22.

The cleaning unit 24 is able to clean the nozzle apertures 111 and the like of the ejection head 20 either regularly or at any time during a device manufacturing process or during a standby period. The capping unit 22 may cap the liquid droplet ejection surface 20*a* during a standby period when no device is being manufactured such that the liquid droplet ejection surface 20*a* of the ejection head 20 does not dry out, or may be used when the cavities 121 are being filled with liquid droplets, or may repair the ejection head 20 when a ejection malfunction occurs.

Capping Unit

Figure 4A:
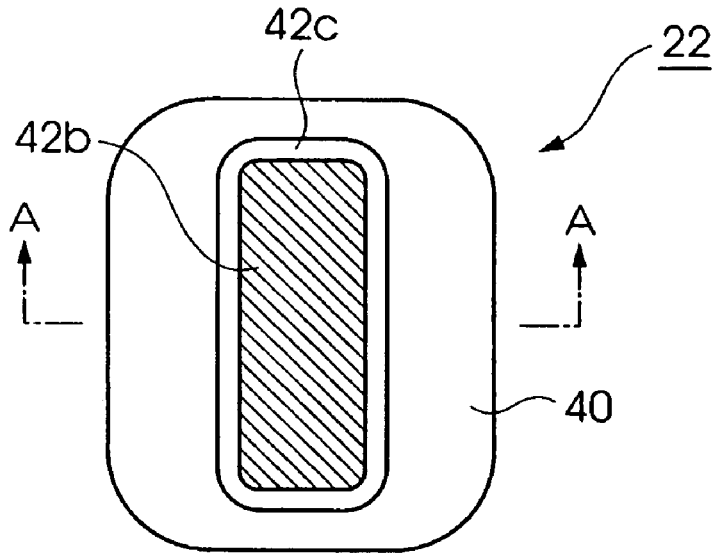
FIGS. 4A is a plan view showing the structure of a capping unit 22.
Figure 4B:
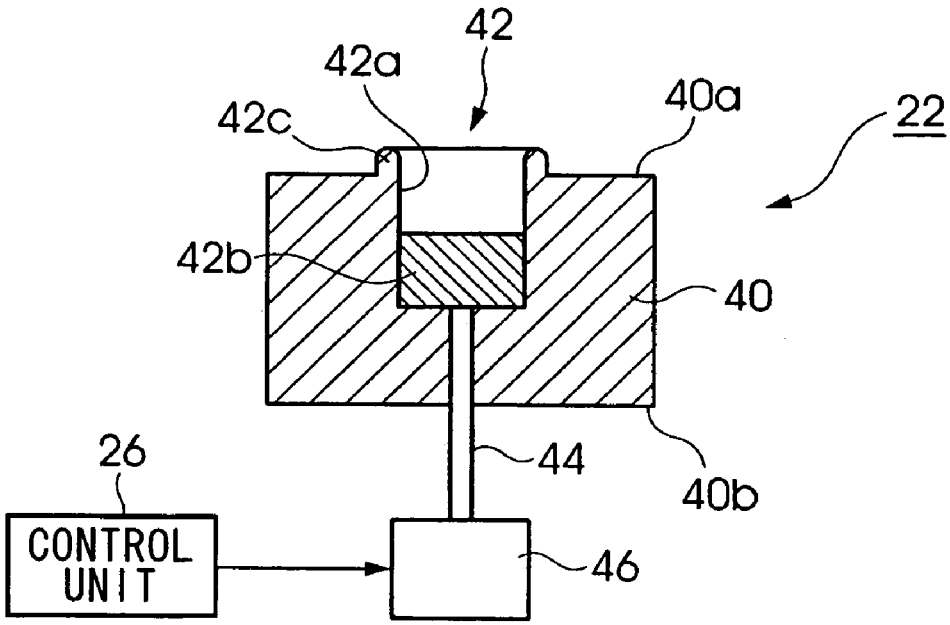
FIGS. 4B is a cross-sectional view showing the structure of a capping unit 22 taken along the arrow line A-A in FIG. 4A.

Next, the capping unit 22 will be described in detail. FIGS. 4A and 4B are views showing the structure of the capping unit 22. FIG. 4A is a plan view of the capping unit 22 as seen from the ejection head 20 side, while FIG. 4B is a cross-sectional view taken along the arrow line A-A in FIG. 4A. As shown in FIGS. 4A and 4B, the capping unit 22 is configured so as to include a body 40, a capping section 42 (i.e., a sealing section), a connecting tube 44, and a pump (i.e., a negative pressure supply device) 46.

The capping section 42 is provided with a wetting member 42*b* that is fitted in an internal portion of a concave portion 42*a* that is formed in the body 40, and a protruding portion 42*c* that protrudes from a top surface 40*a* of the body 40. The connecting tube 44 that penetrates a bottom surface 40*b* of the body 40 is connected to a bottom surface of a concave portion 42*a*. Here, the wetting member 42*b* is formed by a material such as, for example, a sponge that has excellent properties of absorbing liquid droplets ejected from the ejection head 20 and that maintains this wet state when the liquid droplets are absorbed. The pump 46 suctions and depressurizes (i.e., supplies negative pressure to) the capping section 42 via the communicating tube 44. The pump 46 is electrically connected to the control unit 26, and the driving of the pump 46 is controlled by the control unit 26.

Returning to FIG. 1, a liquid droplet ejection apparatus IJ of the present embodiment is provided with a ejection detection unit 38 that determines whether or not there is a nozzle aperture 111 that is not ejecting liquid droplets (i.e., whether there are missing dots) from among the plurality of nozzle apertures 111 provided in the liquid droplet ejection surface 20*a* of the ejection head 20. The ejection detection unit 38 may be formed, for example, by a laser light source and a photodetector that detects laser light from the laser light source. The laser light source and the photodetector are placed so as to sandwich a trajectory of the liquid droplets that are ejected from each of the nozzle apertures 111 when the position of the ejection head 20 in the X direction is positioned at a predetermined position. The laser light source and photodetector detect whether or not there are missing dots based on whether or not there is a change in the amount of light that is detected by the photodetector when liquid droplets are ejected in sequence from each of the nozzle apertures 111.

The ejection detection unit 38 may also be formed by a printing unit on which the liquid droplets from each of the nozzle apertures 111 are printed and that is formed such that a printing surface thereof can be cleaned by a wiper or the like, and by an image pickup element such as a charge coupled device (CCD) that is set so as to be optically coupled with the printing unit by an optical lens or the like. When the ejection detection unit 38 is formed using this structure, the printing surface is printed by ejecting liquid droplets from each of the nozzle apertures 111. Image processing is then performed on image signals that are obtained by an image pickup of the printed surface by the image pickup element, which then enables a detection to be made as to whether or not there are any missing dots.

Figure 5:
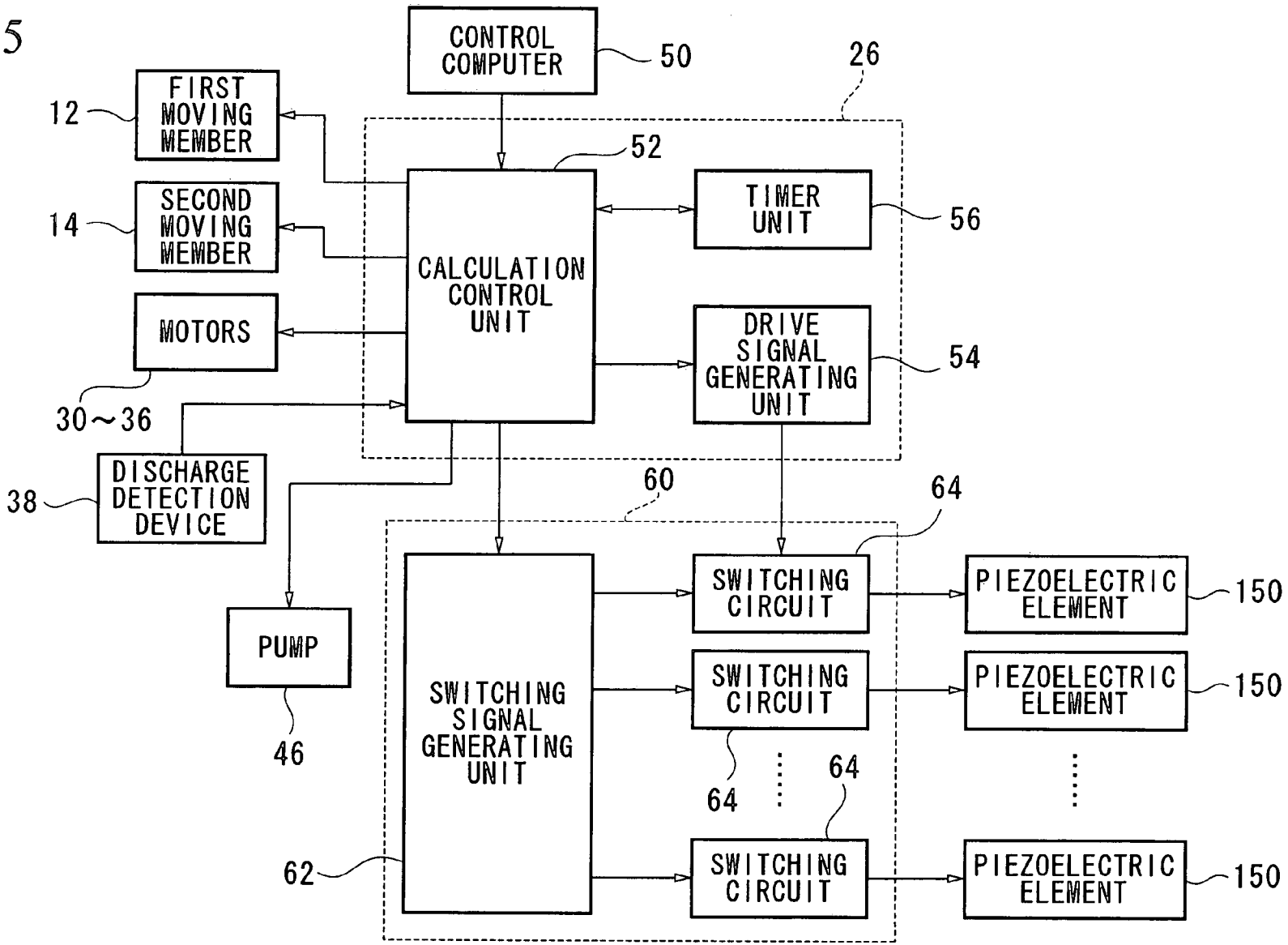
FIG. 5 is a block diagram showing a structure of electric functions of the liquid droplet ejection apparatus according to an embodiment of the present invention.

Next, a description will be given of the structure of the electrical functions of the liquid droplet ejection apparatus IJ of the present embodiment. FIG. 5 is a block diagram showing the structure of the electrical functions of the liquid droplet ejection apparatus according to an embodiment of the present intention. Note that, in FIG. 5, the same reference symbols are allocated to blocks that correspond to members shown in FIGS. 1 to 4B. As shown in FIG. 5, the electrical structure that controls the liquid droplet ejection apparatus IJ is configured so as to include a control computer 50, the control unit 26, and a drive integrated circuit 60.

The control computer 50 may be formed so as to include, for example, a central processing unit (CPU), an internal storage such as random access memory (RAM) and read-only memory (ROM), a hard disk, an external storage such as a CD-ROM, and a display apparatus such as a liquid crystal display apparatus or a cathode ray tube (CRT). The control computer 50 outputs control signals that control operations of the liquid droplet ejection apparatus IJ in accordance with a program stored in ROM or on a hard disk. This control computer 50 is connected to the control unit 26 that is provided in the liquid droplet ejection apparatus IJ shown in FIG. 1 using, for example, a cable or the like.

The control unit 26 is configured so as to include a calculation control unit 52, a drive signal generation unit 54, and a timer unit 56. The calculation control unit 52 drives the first moving member 12, the second moving member 14, and the motors 30 to 36 and also controls the operation of the pump 46 that is provided in the capping unit 22 based on control signals that are input from the control computer 50 and on a control program that is stored internally in advance.

The calculation control unit 52 also outputs a variety of data (i.e., drive signal generation data) that is used to generate various drive signals that drive the plurality of piezoelectric elements 150 that are provided in the ejection head 20. Based on the aforementioned control program, the calculation control unit 52 also generates selection data and outputs this to a switching signal generating unit 62 that is provided in the drive integrated circuit 60. This selection data is made up of nozzle selection data that is used to specify the piezoelectric elements 150 to which the drive signals are to be applied, and waveform selection data that is used to specify the drive signals that are applied to the piezoelectric elements 150.

In addition, the calculation control unit 52 uses the timer unit 56 to measure the length of time that the ejection head 20 has been capped (i.e., sealed) using the capping unit 22, and also controls the length of time that the vicinity of the nozzle apertures 111 has been heated using the piezoelectric elements 150 and the length of time that the pump 46 has been driven. Based on detection results from the ejection detection unit 38, the calculation control unit 52 also controls the capping or cleaning of the ejection head 20.

The drive signal generation unit 54 generates a variety of drive signals having predetermined configurations, namely, normal drive signals or heating drive signals based on the aforementioned drive signal generation data, and outputs them to a switching circuit 64. The timer unit 56, for example, receives the input of a time measurement start signal and a measurement time that are output from the calculation control unit 52, and outputs a time measurement completion signal when the measurement time has passed since the starting of the time measurement.

The drive signal integrated circuit 60 is provided inside the ejection head 20 and is configured so as to include the switching signal generating unit 62 and the switching circuit 64. The switching signal generating unit 62 generates switching signals that command that a drive signal be supplied to or not supplied to the respective piezoelectric elements 150 based on selection data that is output from the calculation control unit 52, and outputs these switching signals to the switching circuit 64. A switching circuit 64 is provided in each piezoelectric element 150, and outputs the drive signal that is instructed by the switching signal to the piezoelectric element 150.

Figure 6A:
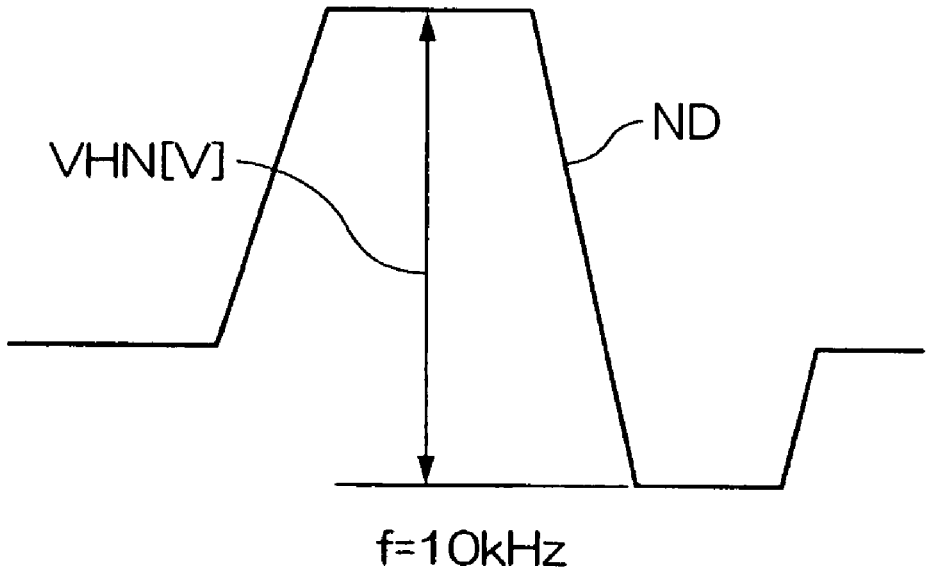
FIGS. 6A and 6B show waveforms of one cycle of normal drive signal and a drive signal for heating that are generated by a drive signal generating unit 54.
Figure 6B:
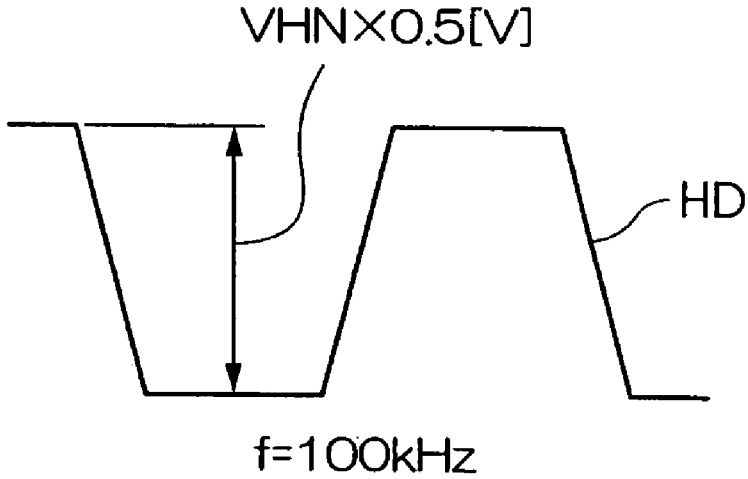

Here, a description will be given of an example of a drive signal generated by the drive signal generation unit 54. FIGS. 6A to 6B are exemplary diagrams showing a waveform of one cycle of a normal drive signal and a drive signal for heating that are generated by a drive signal generating unit 54. FIG. 6A shows the waveform of a normal drive signal ND, while FIG. 6B shows the waveform of a heating drive signal HD. As shown in FIG. 6A, a repetition frequency "f" of the normal drive signal ND is set to 10 kHz, while, as shown in FIG. 6B, a repetition frequency "f" of the heating drive signal HD is set to 100 kHz. Note that, here, a description is given using as an example a case in which the repetition frequency "f" of the heating drive signal HD is set to 100 kHz, however, a frequency in the ultrasonic region of 40 kHz or more is preferable for the repetition frequency "f" of the heating drive signal HD.

A repetition frequency "f" in the vicinity of 100 kHz enables the piezoelectric elements 150 to be driven (i.e., mechanically deformed) sufficiently while, at the same time, this frequency generates operating heat with excellent response by driving the piezoelectric elements 150 at high speed. The amplitude of the heating drive signal HD is set to a size whereby the liquid droplets are not ejected from the nozzle apertures 111, for example, half (i.e., 50%) the amplitude VHN of the normal drive signals ND. Note that, here, a description is given using as an example of a case in which the amplitude of the heating drive signals HD is set to half the amplitude VHN of the normal drive signals ND. However, it is preferable that the amplitude of the heating drive signals HD is half or less the amplitude VHN of the normal drive signals ND.

Liquid Droplet Ejection Method and Capping Unit Control Method

Figure 7:
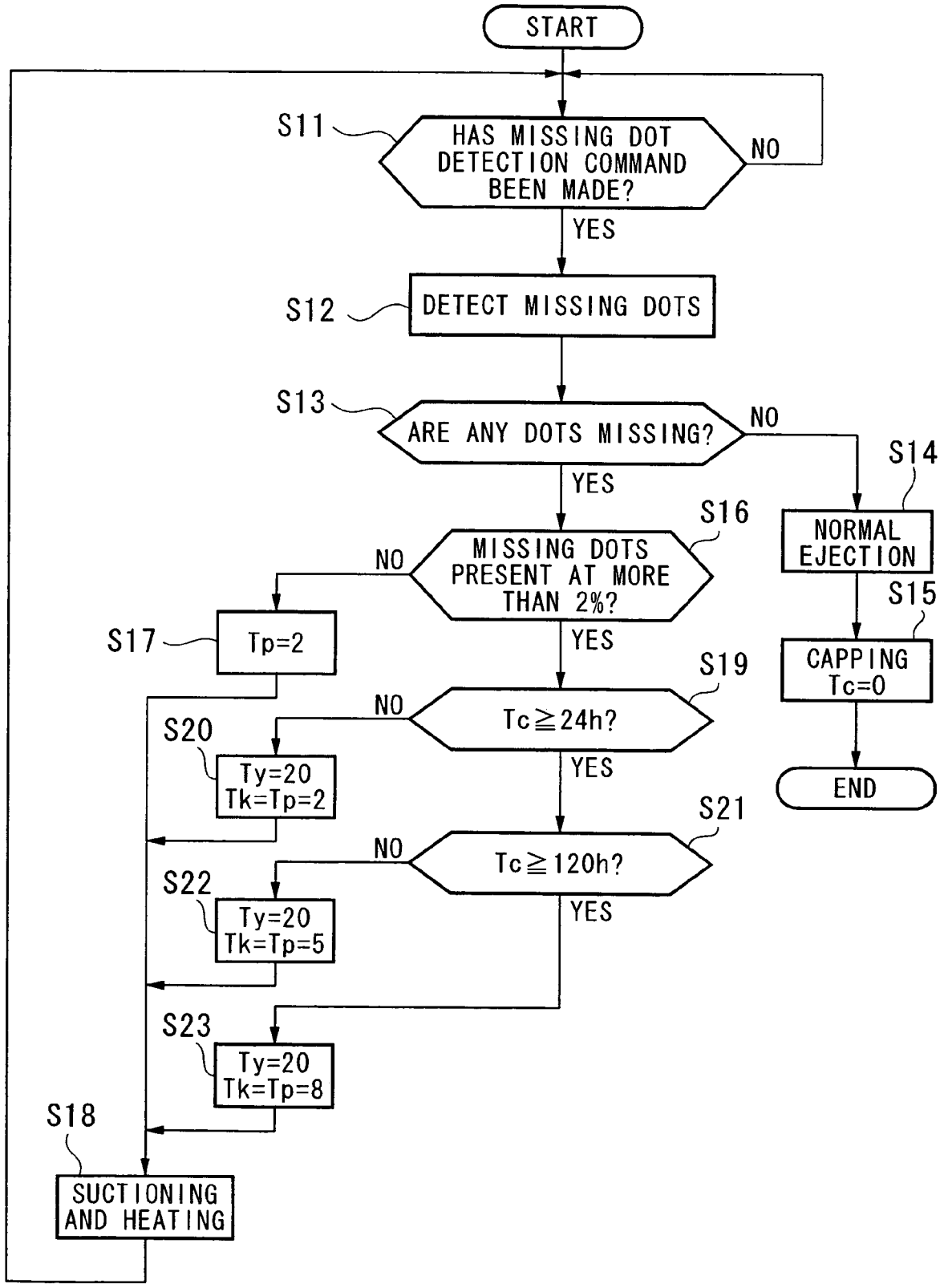
FIG. 7 is a flowchart showing an example of a method for controlling a capping unit according to an embodiment of the present invention.

Next, a method of forming a micro array on the substrate P using the liquid droplet ejection apparatus IJ having the above described structure will be described. In addition, a method for controlling a capping unit that is performed when the micro array is formed will be described. FIG. 7 is a flowchart showing an example of a capping unit control method according to an embodiment of the present invention.

In the flowchart shown in FIG. 7, when the routine is started, a determination is made in the calculation control unit 52 as to whether or not a missing dot detection command is present (step S11). A missing dot detection command is output from the control computer 50 when the power of the liquid droplet ejection apparatus IJ is turned on, or is output from a program of the calculation control unit 52 when a liquid droplet ejection is started or when the substrate P is replaced. This missing dot detection command is also be output from the control computer 50 when an operator of the control computer 50 issues a manual command to the control computer 50. If there is no missing dot detection command (i.e., if the result of the determination is NO), the processing of step S11 is repeated until a missing dot detection command is present.

If, however, in step S11, a missing dot detection command is present (i.e., if the result of the determination is YES), the calculation control unit 52 moves and positions the ejection head 20 so as to drive the second moving member 14 so that the nozzle apertures 111 are placed above (i.e., in the +Z direction) the ejection detection unit 38. When the positioning of the ejection head 20 is completed, the calculation control unit 52 outputs drive signal generation data to the drive signal generation unit 54 so as to generate a normal drive signal ND, and outputs selection data to the switching signal generating unit 62.

Based on the selection data sent from the calculation control unit 52, a switching signal that commands that a drive signal either be supplied or not be supplied to the respective piezoelectric elements 150 is generated in the switching signal generating unit 62, and a normal drive signal ND that is specified by the switching signal is then output to the piezoelectric element 150 by the switching circuit 64. As a result, liquid droplets are ejected from the plurality of nozzle apertures of the ejection head 20 to the ejection detection unit 38, and missing dot detection is performed by the ejection detection unit 38 (step S12).

When the missing dot detection is completed, the result of the detection is output to the calculation control unit 52, and whether or not any missing dots are present is determined by the calculation control unit 52 (step S13). If it is determined that there are no missing dots (i.e., if the result of the determination is NO), then a normal ejection of liquid droplets is performed (step S14). Namely, the calculation control unit 52 controls the first moving member 12 so that the object P is moved to a movement starting position, and controls the second moving member 14 and the like such that the ejection head 20 is moved to a ejection starting position. The drive signal generation data and the selection data are then output respectively to the drive signal generation unit 54 and the switching signal generating unit 62, and normal drive signals ND are then supplied to the piezoelectric elements 150 so that an ejection of liquid droplets onto the substrate P is started.

Once the ejection of liquid droplets has started, the calculation control unit 52 ejects liquid droplets at a predetermined width from predetermined nozzles of the ejection head 20 onto the substrate P while relatively moving (i.e., scanning) the ejection head 20 and the substrate P in the X axial direction, so as to form a micro array on the substrate P. In the present embodiment, the ejection operation is performed while the ejection head 20 moves in the +X direction relative to the substrate P. When one relative movement (i.e. scan) of the ejection head 20 and the substrate P has ended, the stage ST that is supporting the substrate P performs a step movement of a predetermined distance in the Y axial direction relative to the ejection head 20. The calculation control unit 52 then performs a ejection operation while relatively moving (i.e., scanning) for a second time the ejection head 20 relative to the substrate P in, for example, the −X direction. By repeating this operation of plurality of times, the ejection head 20 ejects liquid droplets onto the substrate P based on the control of the calculation control unit 52 so as to form a micro array.

When a micro array has been formed on the substrate P as a result of the above described operation being performed, the calculation control unit 52 controls the first moving member 12 so that the substrate P on which the liquid droplets have been ejected is moved to the unload position. The suction holding by the stage ST is then released, and the substrate P is unloaded from the stage ST by an unloading device (not shown). Next, while the substrate P is being unloaded from the stage ST, the calculation control unit 52 controls the second moving member 14 so that the ejection head 20 is moved in the X axial direction and is positioned above the capping unit 22. The ejection head 20 is then further moved in the Z axial direction, and is placed in contact with the capping unit 22 so that capping of the ejection head 20 is performed (step S15). Once the capping of the ejection head 20 has started, a counter Tc that shows the capping time is reset, and once again measurement of the capping time is started using the timer unit 56. As a result of the above operation, an operation to eject liquid droplets onto one substrate P is completed.

If, however, in step S13, it is determined that missing dots are present (i.e., if the result of the determination is YES), the calculation control unit 52 determines whether or not dots are missing for 2% or more of the nozzle apertures out of all of the nozzle apertures 111 (step S16). If less than 2% of the nozzle apertures have missing dots (i.e., if the result of the determination is NO), the calculation control unit 52 sets the value of a counter Tp that shows the time of the suctioning of the capping section 42 by the pump 46 (i.e., the time that negative pressure is supplied to the capping section 42) to "2" so that the suctioning time is set to two seconds (step S17).

Figure 8:
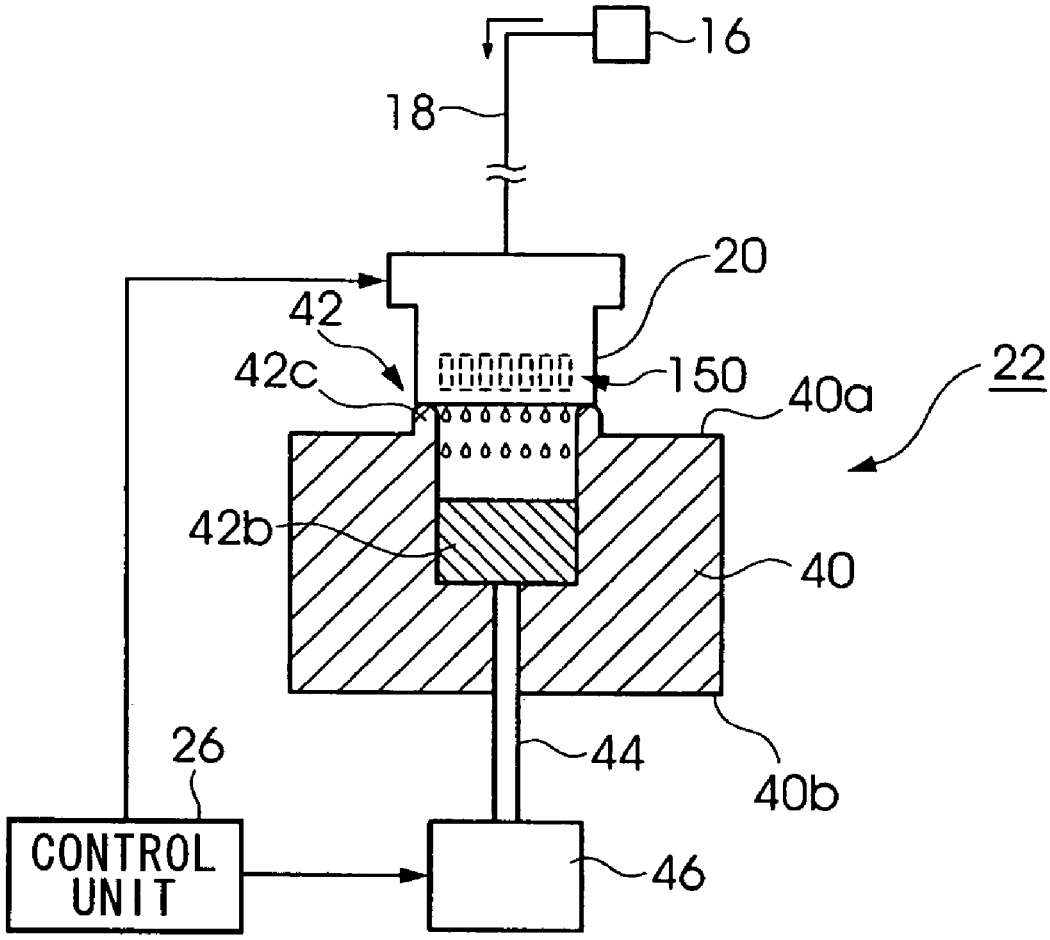
FIG. 8 is a cross-sectional view showing a state in which the ejection head 20 is capped by the capping unit 22.

When the value of the counter Tp has been set, the calculation control unit 52 controls the second moving member 14 so as to move the ejection head 20 and position it above the capping unit 22. The ejection head 20 is then further moved in the Z axial direction, and is placed in contact with the capping unit 22 so that capping of the ejection head 20 is performed. FIG. 8 is a cross-sectional view showing a state in which the ejection head 20 is capped by the capping unit 22. As shown in FIG. 8, the liquid droplet ejection surface 20*a* of the ejection head 20 is placed in front of the wetting member 42*b* of the capping section 42. In addition, the liquid droplet ejection surface 20*a* of the ejection head 20 is engaged with the protruding portion 42*c* and capping is performed.

While capping of the ejection head 20 is being performed by the capping unit 22, the calculation control unit 52 outputs a control signal to the pump 46 so that suctioning is performed by supplying negative pressure to the capping section 42 for the time that was set in the counter Tp (in this example, 2 seconds) (step S18). In step S17, because the value of only the counter Tp that indicates the suctioning time of the capping section 42 is set, here, suctioning only is performed. Once the two seconds of suction have ended, the processing returns to step S11.

If however, in step S16, dots are missing from 2% or more of the nozzle apertures (i.e., if the result of the determination is YES), the calculation control unit 52 determines whether or not the value of the counter Tc that indicates the length of time of the most recent capping time is a value indicating 24 hours or more (step S19). If the value of the counter Tc is less than a value indicating 24 hours (i.e., if the result of the determination is NO), the calculation control unit 52 sets the value of a counter Ty that indicates the preliminary heating time by the piezoelectric elements 150 to "20," so that the preliminary heating time is set to 20 seconds.

Moreover, with the value of the counter Tp that indicates the suctioning time of the capping section 42 by the pump 46 and the value of a counter Tk that indicates the heating time by the piezoelectric elements 150 set to "2," the suctioning time and heating time are set to 2 seconds (step S20). Note that the preliminary heating is advance heating that is performed by the piezoelectric elements 150 prior to the suctioning of the capping section 42. The heating is heating that is performed by the piezoelectric elements 150 together with the suctioning of the capping section 42.

When the values of the counters Ty, Tp, and Tk have been set, the calculation control unit 52 controls the second moving member 14 so that the ejection head 20 is moved and is positioned above the capping unit 22. The calculation control unit 52 then further moves the ejection head 20 in the Z axial direction so that it is placed in contact with the capping unit 22 and the ejection head 20 is capped. As a result, the ejection head 20 is capped in the same manner as shown in FIG. 8.

While the capping of the ejection head 20 by the capping unit 22 is performed, the calculation control unit 52 firstly outputs a heating drive signal HD to the ejection head 20, and performs preliminary heating of the vicinity of the nozzle apertures 111 (i.e., of the liquid droplet solvent inside the cavities 121) for the length of time that is set in the counter Ty (in this example, 20 seconds). When the preliminary heating ends, a heating drive signal HD is output to the ejection head 20 for the length of time that is set in the counter Tk (in this example, 2 seconds), and the vicinity of the nozzle apertures 111 is heated. At the same time as this, negative pressure is supplied to the capping section 42 for the length of time that is set in the counter TP (in this example, 2 seconds), and suctioning is performed (step S18). Once the above described operations have ended, the processing returns to step S11.

In the processing when step S18 is performed via step S16 and step S17, only two seconds of suctioning are conducted because the number of missing dots is small. However, in the processing when step S18 is performed via step S19 and step 20, because the number of missing dots is large, preliminary heating is performed so that the viscosity of the liquid droplet solvent that has become thicker in the vicinity of the nozzle apertures 111 is lowered, or so that solidified liquid droplet solvent is melted, and after this the heating and suction are performed.

Figure 9A:
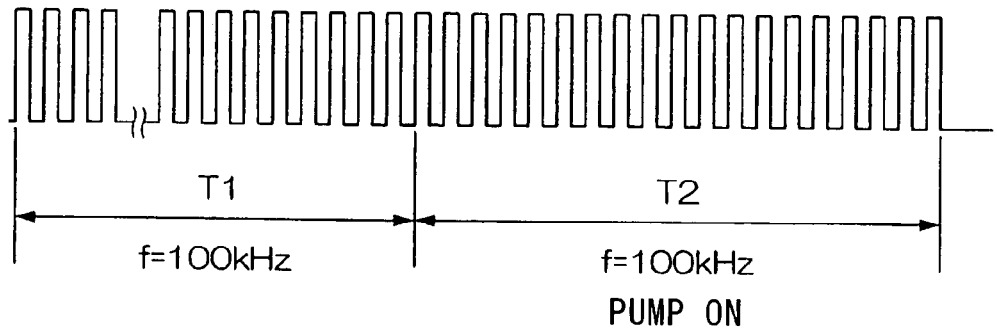
FIGS. 9A to 9C show a relationship between a preliminary heating period and a heating period of the piezoelectric elements 150 and a suctioning time of a capping section 42.
Figure 9B:
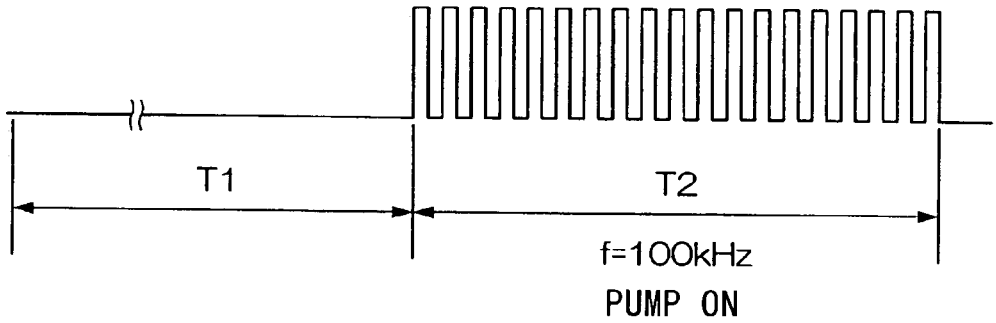
Figure 9C:
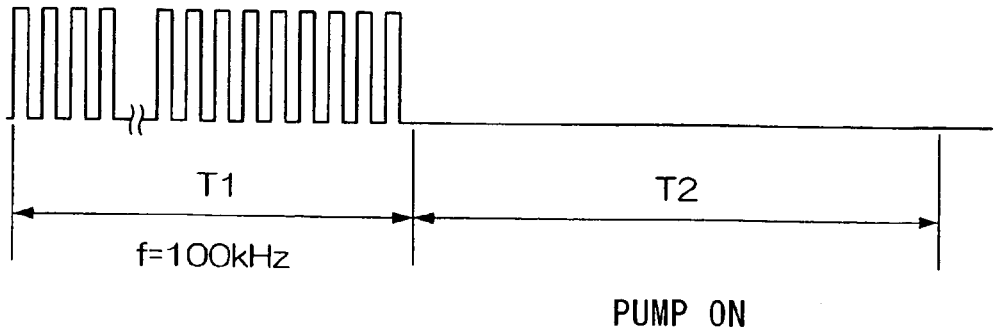

Here, a description will be given of the heating period by the piezoelectric elements 150 and of the suction period of the capping section 42. FIGS. 9A to 9C are views showing the relationship between a preliminary heating period and a heating period of the piezoelectric elements 150 and a suctioning time of a capping section 42. As shown in FIG. 9A, there are provided a first period T1 and a second period T2, and a heating drive signal HD whose repetition frequency "f" is 100 kHz is supplied to the piezoelectric elements 150 during these periods, so that the vicinity of the nozzle apertures 111 is heated.

In the first period T1, a heating drive signal HD is supplied to the piezoelectric elements 150, however, the suctioning of the capping section 42 is not performed. In contrast to this, in the second period T2, a heating drive signal HD is supplied to the piezoelectric elements 150 and suctioning of the capping section 42 is also performed. As is described above, because the preliminary heating is advance heating that is performed by the piezoelectric elements 150 prior to the suctioning of the capping section 42, the above first period T1 is the preliminary heating period, and the second period T2 is the heating period and suctioning period. Namely, in the present embodiment, the heating period and the suctioning period are set as the same period.

Returning to FIG. 7, if, in step 19, the value of the counter Tc is a value indicating 24 hours or more (i.e., if the result of the determination is YES), the calculation control unit 52 determines whether or not the value of the counter Tc that shows the length of time of the most recent capping time is a value indicating 120 hours or more (step S21). If the value of the counter Tc is less than a value indicating 120 hours (i.e., if the result of the determination is NO), the calculation control unit 52 sets the value of a counter Ty that shows the preliminary heating time by the piezoelectric elements 150 to "20," so that the preliminary heating time is set to 20 seconds. Moreover, with the value of the counter Tp that indicates the suctioning time of the capping section 42 by the pump 46 and the value of a counter Tk that indicates the heating time by the piezoelectric elements 150 set to "5," the suctioning time and heating time are set to 5 seconds (step S22).

When the values of the counters Ty, Tp, and Tk have been set, the calculation control unit 52 controls the second moving member 14 so that the ejection head 20 is moved and is positioned above the capping unit 22. The calculation control unit 52 also moves the ejection head 20 in the Z axial direction so that it is placed in contact with the capping unit 22 and the ejection head 20 is capped in the same manner As shown in FIG. 8. While the capping of the ejection head 20 is performed by the capping unit 22, the calculation control unit 52 firstly outputs a heating drive signal HD to the ejection head 20, and performs preliminary heating of the vicinity of the nozzle apertures 111 (i.e., of the liquid droplet solvent inside the cavities 121) for the length of time that is set in the counter Ty (in this example, 20 seconds).

When the preliminary heating has ended, a heating drive signal HD is output to the ejection head 20 for the length of time that is set in the counter Tk (in this example, 5 seconds), and the vicinity of the nozzle apertures 111 is heated. At the same time as this, negative pressure is supplied to the capping section 42 for the length of time that is set in the counter TP (in this example, 5 seconds), and suctioning is performed (step S18). Once the above described operations have ended, the processing returns to step S11.

Comparing the processing when step S18 is performed via step S16 and step S17 with processing when step S18 is performed via step S19 to step S21 and S22, the times of the counter Tk that indicates the heating time and of the counter Tp that indicates the suctioning time are longer. If the time that the ejection head 20 has been capped by the capping unit 22 is one day (i.e., 24 hours) or more and less than five days (i.e., 120 hours), there is a possibility that the liquid droplet solvent will have thickened due to evaporation, therefore the heating time and suctioning time that are required to reliably clear up blockages of the nozzle apertures 111 and the like are lengthened.

If, however, in step S21, the value of the counter Tc is a value indicating 120 hours or more (i.e., if the result of the determination is YES), the calculation control unit 52 sets the value of the counter Ty that shows the preliminary heating time by the piezoelectric elements 150 to "20," so that the preliminary heating time is set to 20 seconds. Moreover, with the value of the counter Tp that indicates the suctioning time of the capping section 42 by the pump 46 and the value of a counter Tk that indicates the heating time by the piezoelectric elements 150 set to "8," the suctioning time and heating time are set to 8 seconds (step S23).

When the values of the counters Ty, Tp, and Tk have been set, the calculation control unit 52 performs capping on the ejection head 20 in the same way As shown in FIG. 8. While the capping is performed, the calculation control unit 52 firstly outputs a heating drive signal HD to the ejection head 20, and performs preliminary heating of the vicinity of the nozzle apertures 111 (i.e., of the liquid droplet solvent inside the cavities 121) for the length of time that is set in the counter Ty (in this example, 20 seconds). When the preliminary heating has ended, a heating drive signal HD is output to the ejection head 20 for the length of time that is set in the counter Tk (in this example, 8 seconds), and the vicinity of the nozzle apertures 111 is heated. At the same time as this, negative pressure is supplied to the capping section 42 for the length of time that is set in the counter TP (in this example, 8 seconds), and suctioning is performed (step S18). Once the above described operations have ended, the processing returns to step S11.

In this manner, if the time that the ejection head 20 has been capped by the capping unit 22 is five days (i.e., 120 hours) or more, there is an extremely strong possibility that the liquid droplet solvent will have thickened, therefore the heating time and suctioning time are lengthened even more so that the ejection amount of liquid droplet is increased, thereby reliably clearing up blockages of the nozzle apertures 111 and the like. As has been described above, in the present embodiment, because the heating time and suctioning time are changed in accordance with the capping time of the ejection head 20, unnecessary consumption of liquid droplet solvent can be considerably reduced in accordance with the extent of the solidification or the extent of the thickening of the liquid droplet solvent, and it is possible to reliably clear up blockages of the nozzle apertures in a short time span.

Note that, in the above described embodiment, because the vicinities of the nozzle apertures 111 are heated by applying a heating drive signal HD to the piezoelectric elements 150, a structure in which a temperature sensor that detects the temperature in the vicinity of the nozzle apertures 111 of the piezoelectric elements 150 is provided inside the ejection head 20 is desirable. If the heating drive signals HD are supplied to the piezoelectric elements 150, it is preferable that the piezoelectric elements are driven by performing feedback on the detection results from the temperature sensor. By performing driving such as this, it is possible to keep the heating temperature constant irrespective of the surrounding temperature, and it is possible to effectively lower the viscosity of liquid droplet solvent that has thickened or melt solidified liquid droplet solvent, resulting in it becoming possible to reliably clear blockages of the nozzle apertures in a short time span.

Moreover, in the above described embodiment, the piezoelectric elements 150 are used as a heating unit to heat the vicinity of the nozzle apertures 111, however, it is also possible to provide a heater separately from the piezoelectric elements 150. If a heater is used, then it is possible to heat not only the nozzle apertures 111, but also the entire ejection head 20 and also the tank 16 and flow passages 18. It also becomes possible to more effectively lower the viscosity of thickened liquid droplet solvent, or to more effectively melt solidified liquid droplet solvent.

Furthermore, in the flowchart shown in FIG. 7, either the suctioning by the pump 46 only is performed, or else the suctioning is performed while heating is applied after the preliminary heating. However, As shown in FIG. 9B, it is also possible to perform the suctioning while applying heating without the preliminary heating having been performed, or, As shown in FIG. 9C, it is possible to perform the suctioning without applying heating after having applied the preliminary heating. Provided that blockages in the nozzle apertures 111 and the like are reliably cleared, then it is desirable to perform the suctioning while applying heating after the preliminary heating has been applied, as in the above described embodiment.

Moreover, in the above described embodiment, the length of time for which the suctioning is performed together with the heating is changed in accordance with the length of time of the most recent capping time of the ejection head 20, however, this assumes that the suctioning force of the pump 46 is constant. If it is possible to vary the suctioning force of the pump 46, then it is also possible to vary the quantity ejected from the nozzle apertures 111 by changing the suctioning force (i.e., by changing the size of the negative pressure). Note that when changing the suctioning force, the suctioning time may be either constant or may be changed together with the suctioning force.

Device Manufacturing Methods and Electronic Instrument

A description has been given above of a capping unit according to an embodiment of the present invention, as well as to a control method for this capping unit and a liquid droplet ejection apparatus. This liquid droplet ejection apparatus can be used as a film forming apparatus that forms a film, a wiring apparatus that forms wiring such as metal wiring, or as a device manufacturing apparatus to manufacture devices such as a micro lens array, a liquid crystal display apparatus, an organic EL device, a plasma display device, and a field emission display (FED).

Using the above described liquid droplet ejection apparatus, after the viscosity of liquid droplet solvent that has thickened has been lowered or after solidified liquid droplet solvent has been melted, it is ejected. Using an ejection head 20 that has finished undergoing this processing, a pattern is formed on a substrate P by ejecting liquid droplets. As a result, it is possible to restrain unnecessary consumption of liquid droplet solvent, and also lengthen the liquid droplet ejection time for forming patterns. Consequently, it is possible to reduce device manufacturing costs and improve throughput.

Devices such as the above described liquid crystal device, organic EL device, plasma display device, and FED are provided in electronic apparatuses such as notebook computers and mobile telephones. However, the electronic apparatuses are not limited to these notebook computers and mobile telephones, and the present invention may be applied to a variety of electronic apparatuses. For example, the present invention can be applied to electronic apparatuses such as liquid crystal projectors, personal computers (PC) and engineering workstations (EWS) for multimedia applications, pagers, word processors, televisions, viewfinder type or direct monitor view type video recorders, electronic organizers, electronic desk calculators, car navigation devices, POS terminals, and apparatuses that are provided with touch panels.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as limited by the foregoing description and is only limited by the scope of the appended claims.

What is claimed is:

1. A capping apparatus comprising:

a sealing unit that seals at least nozzle apertures of a liquid droplet ejection head that ejects liquid droplets;

a heating unit that heats at least a vicinity of the nozzle apertures;

a negative pressure supplying unit that supplies an interior of the sealing unit with negative pressure that causes liquid droplets to be ejected from the nozzle apertures;

a detection unit that makes a determination as to whether or not an ejection of the liquid droplets has been made from each of the nozzle apertures; and a control unit that controls at least one of a drive signal generating unit and the negative pressure supplying unit provided in the capping apparatus in accordance with detection results of the detection unit, that controls a heating time of the vicinity of the nozzle apertures by the heating unit, that controls a negative pressure supply time by the negative pressure supplying unit, and that includes a time measuring unit measuring a length of time during which the nozzle apertures have been sealed by the sealing unit, and that performs control to change the heating time and the negative pressure supply time in accordance with the length of time measured by the time measuring unit.

2. The capping apparatus according to claim 1, further comprising a temperature measuring unit that measures a temperature in the vicinity of the nozzle apertures, wherein the heating unit adjusts a heating temperature of the vicinity of the nozzle apertures based on the temperature measured by the temperature measuring unit.

3. The capping apparatus according to claim 1, wherein the detection unit includes a laser light source and a photodetector detecting laser light from the laser light source, the laser light source and the photodetector are placed so as to sandwich a trajectory of the liquid droplets that are ejected from each of the nozzle apertures.

4. A method for controlling a capping apparatus including a sealing unit that seals at least nozzle apertures of a liquid droplet ejection head that eject liquid droplets, comprising:

heating at least a vicinity of the nozzle apertures of the liquid droplet ejection head;

supplying an interior of the sealing unit with negative pressure so that liquid droplets are ejected from the nozzle apertures;

making a determination as to whether or not an ejection of the liquid droplets has been made from each of the nozzle apertures;

heating the vicinity of the nozzle apertures and supplying negative pressure to the interior of the sealing unit in accordance with the determination;

measuring a length of time during which the nozzle apertures have been sealed by the sealing unit; and changing a length of time during which the vicinity of the nozzle apertures is heated and a length of time during which the interior of the sealing unit is supplied with negative pressure in accordance with the length of time that the nozzle apertures have been sealed measured by the sealing unit.

5. The method for controlling a capping apparatus according to claim 4, wherein heating the vicinity of the nozzle apertures of the liquid droplet ejection head and supplying an interior of the sealing unit with negative pressure so that liquid droplets are ejected from the nozzle apertures are performed at the same time.

6. The method for controlling a capping apparatus according to claim 5, wherein the heating of the vicinity of the nozzle apertures and the supplying of negative pressure are performed at the same time after the vicinity of the nozzle apertures has undergone preliminary heating.

7. The method for controlling a capping apparatus according to claim 4, wherein the heating of the vicinity of the nozzle apertures and the supplying an interior of the sealing unit with negative pressure are performed after the vicinity of the nozzle apertures has undergone preliminary heating.

8. The method for controlling a capping apparatus according to claim 4, further comprising changing a magnitude of the negative pressure that is supplied to the interior of the sealing unit.

9. The method for controlling a capping apparatus according to claim 4, wherein the making of a determination includes:

preparing a detection unit that includes a laser light source and a photodetector detecting laser light from the laser light source, the laser light source and the photodetector being placed so as to sandwich the trajectory of the liquid droplets that are ejected from each of the nozzle apertures; and detecting whether or not there are missing dots based on whether or not there is a change in the amount of light that is detected by the photodetector when liquid droplets are ejected in sequence from each of the nozzle apertures.

10. A liquid droplet ejection apparatus comprising:

a liquid droplet ejection head including: pressure generating elements that generate pressure in response to a supplied drive signal, and nozzle apertures from which are ejected liquid droplets that are pressurized by pressure generated by the pressure generating elements;

a drive signal generating unit that supplies the pressure generating elements with a heating drive signal that heats a vicinity of the nozzle apertures without causing liquid droplets to be ejected from the nozzle apertures;

a capping apparatus including: a sealing unit that seals the nozzle apertures, and a negative pressure supplying unit that supplies an interior of the sealing unit with negative pressure that causes liquid droplets to be ejected from the nozzle apertures;

a detection unit that makes a determination as to whether or not an ejection of the liquid droplets has been made from each of the nozzle apertures; and a control unit that controls at least one of the drive signal generating unit and the negative pressure supplying unit provided in the capping apparatus in accordance with detection results of the detection unity, that includes a time measuring unit measuring a length of time during which the nozzle apertures have been sealed by the sealing unit, and that controls a length of time during which the drive signal generating unit supplies the pressure generating elements with the heating drive signals and a length of time during which the interior of the sealing unit is supplied with negative pressure in accordance with the length of time measured by the time measuring unit.

11. The liquid droplet ejection apparatus according to claim 10, wherein the heating drive signal has a repetition frequency in an ultrasonic frequency band.

12. The liquid droplet ejection apparatus according to claim 11, wherein the repetition frequency is 40 kHz or more.

13. The liquid droplet ejection apparatus according to claim 10, wherein an amplitude of the heating drive signals is half or less an amplitude of a drive signal that is applied to the pressure generating element when the liquid droplets are ejected from the nozzle apertures.

14. The liquid droplet ejection apparatus according to claim 10, wherein the detection unit includes a laser light source and a photodetector detecting laser light from the laser light source, the laser light source and the photodetector being place so as to sandwich the trajectory of the liquid droplets that are ejected from each of the nozzle apertures.

* * * * *